US005906720A

United States Patent [19]

Ferguson et al.

[11] Patent Number: 5,906,720

[45] Date of Patent: May 25, 1999

[54] PROCESS FOR PREPARING A PHOSPHOR LAYER OF A CATHODE RAY TUBE

[75] Inventors: Mona Ferguson, Ulm; Michael Gailberger, Neu-Ulm; Karl Holdik, Ulm; Anja Keller, Blaustein; Gunter Maetze, Herrlingen; Gerhard Gassler, Ulm, all of Germany

[73] Assignee: AEG Elektronische Röhren GmbH, Ulm, Germany

[21] Appl. No.: 08/899,660

[22] Filed: Jul. 24, 1997

[30] Foreign Application Priority Data

Jul. 25, 1996 [DE] Germany ..... 196 30 016

[51] Int. Cl.[6] ..... C25D 13/12

[52] U.S. Cl. ..... 204/488; 204/487; 204/490; 204/491; 204/485

[58] Field of Search ..... 204/491, 490, 204/484, 485, 487, 488

[56] References Cited

U.S. PATENT DOCUMENTS

| | | | |
|---|---|---|---|
| 3,525,679 | 8/1970 | Wilcox et al. | 204/490 |
| 5,399,449 | 3/1995 | Tanimoto | 204/485 |
| 5,582,703 | 12/1996 | Sluzky et al. | 204/490 |
| 5,717,282 | 2/1998 | Oomen | 313/479 |

FOREIGN PATENT DOCUMENTS

| | | |
|---|---|---|
| 0 447 078 A2 | 9/1991 | European Pat. Off. . |
| 0 715 004 A1 | 6/1996 | European Pat. Off. . |
| 29 09 147 A1 | 9/1979 | Germany . |

*Primary Examiner*—Kishor Mayekar
*Attorney, Agent, or Firm*—McGlew and Tuttle, P.C.

[57] ABSTRACT

A process for preparing a phosphor layer of a cathode ray tube. To prepare a phosphor layer located on the display screen rear side of the cathode ray tube, the display screen rear side is first coated with an electrically conductive electrode layer consisting of electrically conductive polymers; a solution containing the phosphors or their precursors as well as a solution containing an electrolyte are deposited on the electrode layer; an electric field is applied between the electrode layer and the solution; and the phosphors are electrophoretically deposited on the electrode layer to form the phosphor layer. Since polymers with an evaporation temperature below the destruction temperature of the phosphors are selected, the electrode layer can subsequently be removed by evaporating the polymers.

10 Claims, 3 Drawing Sheets

PROCESS FOR PREPARING A PHOSPHOR LAYER OF A CATHODE RAY TUBE

FIELD OF THE INVENTION

The present invention pertains to a process for preparing a phosphor layer of a cathode ray tube and more particularly to a process in which the display screen rear side of the cathode ray tube is coated with an electrically conductive layer. A solution, suspension, or dispersion containing an electrolyte (hereinafter called the phosphor solution for simplicity's sake) is applied and a layer is formed by a drying process. Phosphor or precursors thereof dissolved in an electrolyte are brought in contact with the electrode layer and deposited by an electrophoretic process. The electrode layer is subsequently removed, wherein the phosphor layer is left on the rear side of the display screen for the industrial manufacture of monitors.

BACKGROUND OF THE INVENTION

Three processes are used, among other things, for preparing the phosphor layer in the production of cathode ray tubes for monitors, display screens, etc.: The brushing process, the spin coating process, and electrophoresis.

The substances of the phosphor layer, hereinafter called phosphors, are applied by means of a brushing sponge in the brushing process. However, phosphor layers applied in this manner have a relatively low homogeneity, Furthermore, the excess material is wasted and must be recycled or disposed of in an expensive process.

In the spin coating process, the phosphor layer is prepared from a mixture of a lacquer paste based on, e.g., ethyl cellulose and the phosphors. The phosphor-lacquer mixture is applied to the rear side of the picture side, i.e., to the side facing a later observer. After the distribution of this lacquer mixture, the cathode ray tube is rotated around an axis orthogonal to the picture side. After drying of the lacquer mixture, the lacquer mixture is heated to above 200° C. and especially up to 400° C., as a result of which the binder is destroyed and the phosphors remain on the rear surface of the picture side. However, the distribution of the phosphors is inhomogeneous, as a result of which the layer thickness of the phosphor layer, especially the layer thickness measured in parallel to the surface of the picture side, displays great variations. This process is unsuitable for coating large surfaces due to these differences in layer thickness.

In electrophoresis, the rear side of the display screen is coated with an electrically conductive electrode layer, mostly one consisting of a metal, such as aluminum or ITO (Indium-Tin Oxide). The phosphors are suspended in a solvent. An electrolyte or a mixture of various electrolytes, which dissolve in the solution and/or are suspended in it, is also added to the solution. The solution or the suspension is charged by the electrolyte. To deposit the phosphors and consequently to form the phosphor layer, the solution is brought into contact with the electrode layer, the electrode layer is used as an electrode, a counterelectrode is introduced, and different electrical potentials are applied to two electrodes, as a result of which the phosphors are electrophoretically deposited on the electrode layer, forming the phosphor layer. The layer thickness of the phosphor layer can be set by varying the parameters electrical (deposition) voltage, temperature, deposition time, and the materials used. The phosphors are subsequently optionally to be fixed on the rearward picture side by heating. After the application of the phosphor layer and the optional fixation, the electrode layer must be removed, especially by chemical etching. However, this process has a high reject rate.

SUMMARY AND OBJECTS OF THE INVENTION

The primary object of the present invention is to develop a process with which a phosphor layer can be applied in an inexpensive manner with high reliability, uniform layer thickness and low reject rate.

The object is accomplished according to the present invention with a process wherein a display screen rear side of the cathode ray tube is coated with an electrically conductive layer. A solution suspension or dispersion containing an electrolyte (hereinafter called the phosphor solution for simplicity's sake) is brought into contact with the electrode layer and a layer is formed by drying. Phosphor or precursors thereof dissolved in an electrolyte are brought in contact with the electrode layer and deposited by an electrophoretic process. The electrode layer is subsequently removed, wherein the phosphor layer is left on the rear side of the display screen. Electrically conductive polymers and/or precursors for electrically conductive polymers, hereinafter called electrically conductive polymers for simplicity's sake, whose evaporation temperature is below the destruction temperature of the said phosphor layer, are selected as the electrode material for the electrode layer. The polymers of the electrode layer are removed by evaporation.

The inexpensive electrophoresis, which leads to the best results in terms of layer thickness, can be used to deposit the phosphor layer by the use of materials for the electrode layer that can be thermally expelled below the destruction or decomposition temperature of the phosphor layer, preferably below 400° C. and especially preferably below 250° C. The materials for the electrode layer are also advantageously expelled below the decomposition temperature of the glass solder and of the glass body; the phosphor layers prepared by electrophoresis, which is especially suitable for smaller phosphor layers, have, in particular, a high resolution. The chemical removal of the electrode layer is advantageously eliminated, as a result of which the amount of rejects is reduced and the quality of the phosphor layer is even further improved. This expulsion of the electrode layer may be advantageously carried out simultaneously with the fixation of the phosphor layer (heat fixation).

Intrinsically conductive polymers are preferably selected as the polymer. A crosslinking agent and/or binder is preferably added to the electrode solution containing the polymers. The polymers may be applied as a film. Polyacrylate and/or polyvinyl acetate and/or polyvinyl alcohol may be added to the electrode solution containing the polymers.

Poly(3,4)ethylenedioxythiophene (PEDT) and/or polypyrrol (or as polypyrrole) and/or derivatives thereof may be selected as the conductive polymer. The polymer may be deposited in the presence of polystyrenesulfonic acid. Poly (3,4)ethylenedioxythiophene (PEDT) may be selected as the polymer, and the PEDT may be deposited from an aqueous electrode solution in the presence of polystyrenesulfonic acid.

Poly(3,4)ethylenedioxythiophene (PEDT) may be selected as the polymer; and the PEDT may be deposited from an aqueous PEDT solution the presence of polystyrenesulfonic acid; and a crosslinking agent, especially epoxysilane, may be added to the electrode solution.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
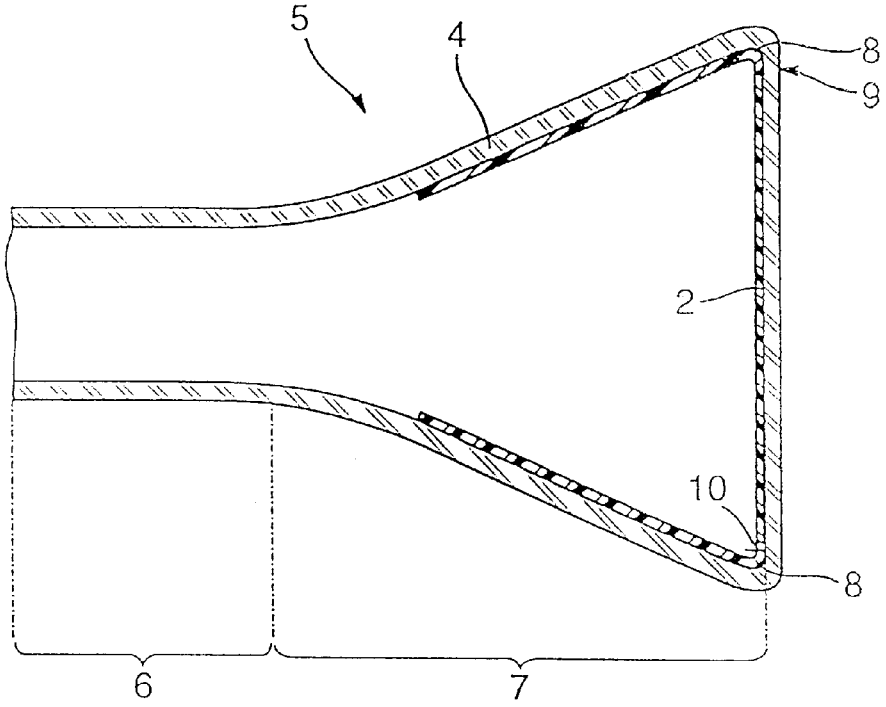
FIG. 1 is a section through a glass body of a display screen of a cathode ray tube.

FIG. 1 shows a section through a glass body 4 of a cathode ray tube 5, wherein an accurate representation of the functional parts of the cathode ray tube 5, such as deflecting capacitors, coils, etc., was intentionally omitted.

The glass body 4 of the cathode ray tube 5 has—from left to right—an area 6 of cylindrical cross section, in which, e.g., the electron-generating means and their control means are accommodated. The cylindrical area 6 is followed by a conical area 7, which is coated on the inside with an electrically conductive layer consisting of graphite 8. The conical area 7 is closed by the display screen 9 in the manner of a bottom. On the rear side 10 of the display screen, the display screen 9 has on the inside a phosphor layer 2. The phosphor layer 2 is arranged firmly adhering to the glass body 5 and can be excited to phosphoresce by means of the electrodes arriving from the conical area 7, so that a picture can be displayed on the display screen 9 by correspondingly controlling the electrons.

The preparation of the phosphor layer 2 is described on the basis of the following FIGS. 2 through 6.

Figure 2:
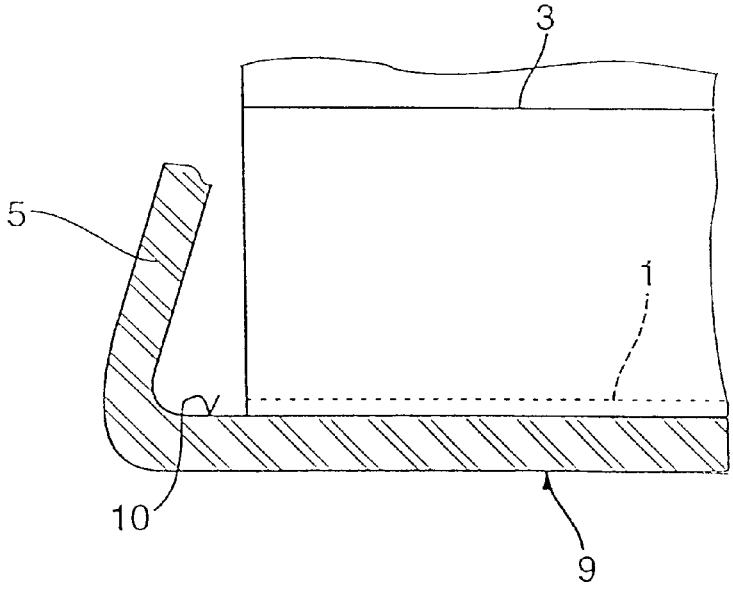
FIG. 2 is a section through a detail of the display screen of a cathode ray tube with the solution applied to form the electrode layer.

FIG. 2 shows a section through a detail of the cathode ray tube 5 in the area of the display screen 9 with the glass body 4 still uncoated. An electrode solution 3, which is suitable for forming an electrode layer 1 from electrically intrinsically conductive polymers and/or precursors for electrically conductive polymers their oligomers, their monomers, or a combination thereof hereinafter called polymers electrically conductive simplicity's sake, on the rear side 10 of the display screen, is applied to the display screen rear side 10 of the glass body 4.

Poly(3,4)ethylenedioxythiophene (PEDT) and/or polypyrrol (or as polypyrrole) and/or polyaniline and/or their derivatives proved to be favorable as conductive polymers.

Polyacrylates and/or polyvinyl acetates and/or polyvinyl alcohols are advantageously added as binders to the electrode solution 3 for forming the electrode layer 1.

It proved to be particularly advantageous to use PEDT as the polymer, and to deposit the PEDT from an aqueous electrode solution 3 in the presence of polystyrenesulfonic acid, adding especially epoxysilane as a crosslinking agent to the electrode solution 3.

Figure 3:
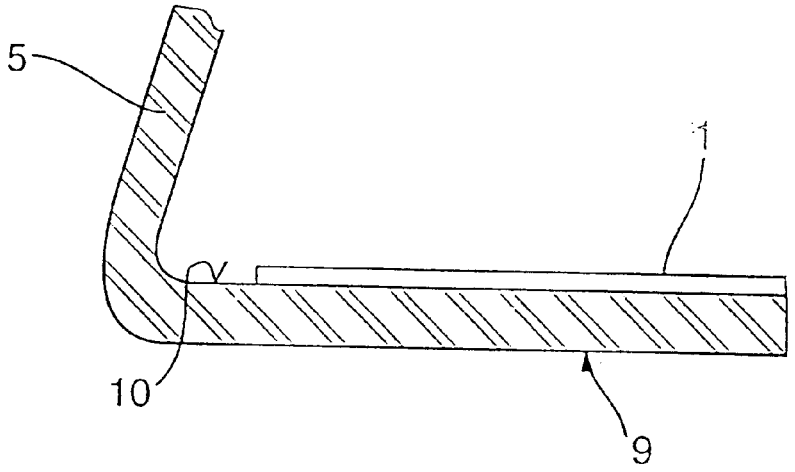
FIG. 3 is the section according to FIG. 1 for the formation of the electrode layer.
Figure 4:
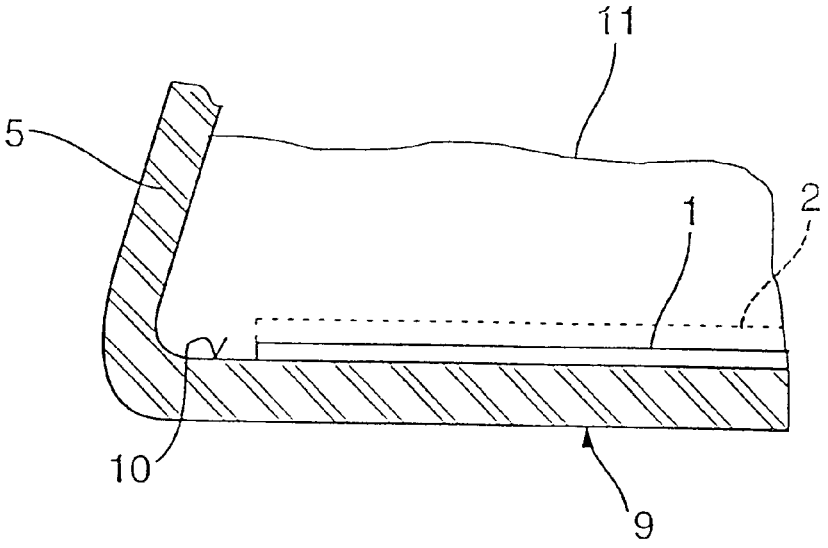
FIG. 4 is the section according to FIG. 3 with the solution of electrolyte and phosphors or their precursors arranged above the electrode layer.

After forming the electrode layer 1 shown in FIG. 3, this layer is electrically contacted and a phosphor solution 11 is applied to it.

The phosphor solution 11 is a simple solution, a suspension or a dispersion; it will hereinafter be called phosphor solution 11 for simplicity's sake, which contains the phosphors or their precursors for the later phosphor layer 2. The phosphor solution 11 also contains an electrolyte.

Figure 5:
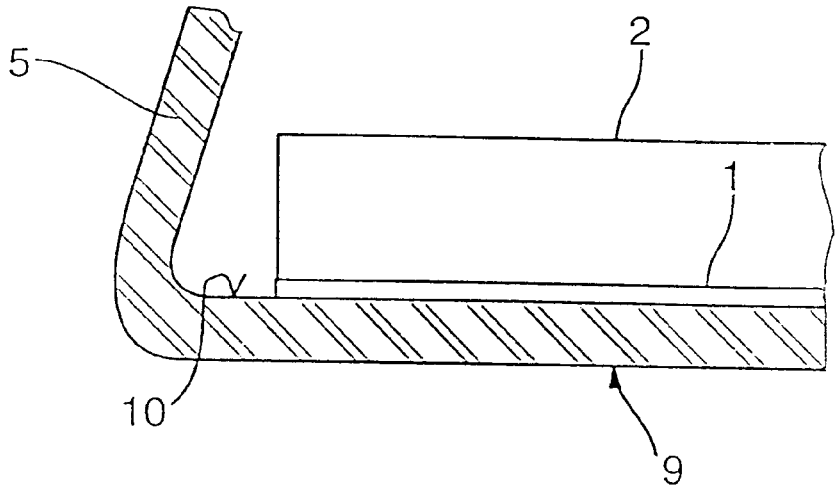
FIG. 5 is the section according to FIG. 4 with phosphor layer deposited on the electrode layer.
Figure 6:
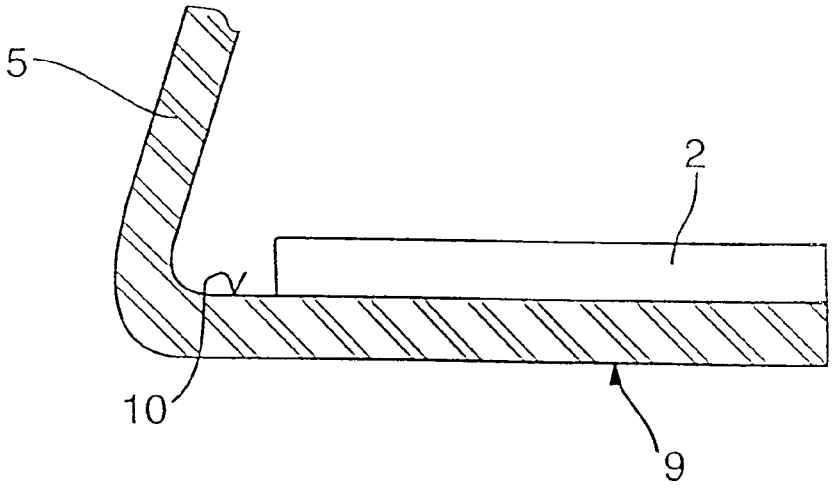
FIG. 6 is the section according to FIG. 5 with the electrode layer removed.

The phosphor solution 11 and the electrode layer 1, which is preferably applied in the form of a film, are connected to an electric power source, as a result of which an electric field is formed between the phosphor solution 11 and the electrode layer 1, and the phosphor layer 2 is deposited electrophoretically from the phosphor solution 11 on the electrode layer 3 (see FIG. 5).

Heating the electrode layer 1 (electrically conductive polymer) and the layer 2 (phosphor layer) to a temperature (preferably below 400° C. and especially below 250° C.) results in a fixed phosphor layer and a degradation of the electrode layer by expelling the fragments. That is the electrode layer 1 is removed after the deposition of the phosphor layer 2. Since electrically conductive polymers with an evaporation temperature that is lower than the destruction temperature of the phosphor layer 2 are to be selected for the electrode layer 1 according to the present invention, the electrode layer 1 is removed thermally.

Since the evaporation temperature of the polymers is advantageously lower than the curing temperature of the phosphor layer 2, the curing of the phosphor layer 2 and the removal of the electrode layer 1 may advantageously be carried out simultaneously by expelling the gaseous decomposition products of the polymers through the phosphor layer 2.

While specific embodiments of the invention have been shown and described in detail to illustrate the application of the principles of the invention, it will be understood that the invention may be embodied otherwise without departing from such principles.

What is claimed is:

1. A process for preparing a phosphor layer of a cathode ray tube, the process comprising the steps of:

coating a display screen rear side of the cathode ray tube with an electrically conductive electrode layer;

bringing into contact a phosphor solution with the electrode layer, the phosphor solution being one of a solution, suspension or dispersion containing the phosphors or their precursors of the later phosphor layer;

applying an electrical field between the electrode layer and the phosphor solution to deposit phosphors electrophoretically on the electrode layer to form the phosphor layer;

selecting an electrically conductive polymer or precursors for electrically conductive polymers, having an evaporation temperature below a destruction temperature of said phosphor layer, as an electrode material for said electrode layer;

removing the electrically conductive polymer or precursors for electrically conductive polymers of said electrode layer by evaporation by heating the electrode layer and the phosphor layer to a temperature sufficient to fix the phosphor layer and degrade the electrode layer by expelling fragments.

2. The process in accordance with claim 1, wherein intrinsically conductive polymers are selected as said electrically conductive polymer or precursors for electrically conductive polymers.

3. The process in accordance with claim 1, wherein a crosslinking agent, binder or a combination thereof is included in said electrode layer containing the electrically conductive polymer or precursors for electrically conductive polymers.

4. The process in accordance with claim 1, wherein said electrically conductive polymer or precursors for electrically conductive polymers are applied as a film.

5. The process in accordance with claim 1, wherein polyacrylate, polyvinyl acetate, polyvinyl alcohol or a combination thereof is included in said electrode layer which contains said electrically conductive polymer or precursors for electrically conductive polymers.

6. The process in accordance with claim 1, wherein poly(3,4)ethylenedioxythiophene (PEDT), polypyrrole, derivatives thereof or a combination thereof is selected as the conductive polymer.

7. The process in accordance with claim 1, wherein said electrically conductive polymer or precursors for electrically conductive polymers is deposited in the presence of polystyrenesulfonic acid.

8. The process in accordance with claim 1, wherein poly(3,4)ethylenedioxythiophene (PEDT) is selected as said polymer, and PEDT is deposited from an aqueous electrode solution in the presence of polystyrenesulfonic acid.

9. The process in accordance with claim 1, wherein poly(3,4)ethylenedioxythiophene (PEDT) is selected as the polymer; and the PEDT is deposited from an aqueous PEDT solution in the presence of polystyrenesulfonic acid; and a crosslinking agent, is included in said electrode layer.

10. The process in accordance with claim 9, wherein epoxysilane is said crosslinking agent.

* * * * *